US006185944B1

(12) United States Patent
Gaul

(10) Patent No.: US 6,185,944 B1
(45) Date of Patent: Feb. 13, 2001

(54) REFRIGERATION SYSTEM WITH A COMPRESSOR-PUMP UNIT AND A LIQUID-INJECTION DESUPERHEATING LINE

(75) Inventor: Christopher J. Gaul, Thornton, CO (US)

(73) Assignee: Midwest Research Institute, Kansas City, MO (US)

( * ) Notice: Under 35 U.S.C. 154(b), the term of this patent shall be extended for 0 days.

(21) Appl. No.: 09/246,080

(22) Filed: Feb. 5, 1999

(51) Int. Cl.[7] ..... F25B 1/00; F25B 31/00
(52) U.S. Cl. ..... 62/115; 62/DIG. 2
(58) Field of Search ..... 62/DIG. 2, DIG. 17, 62/505, 209, 115, 498

(56) References Cited

U.S. PATENT DOCUMENTS

| | | | |
|---|---|---|---|
| 2,023,017 | 12/1935 | Hough | 103/87 |
| 2,031,080 | 2/1936 | Van Deventer | 62/115 |
| 3,650,634 | 3/1972 | Osborne et al. | 415/175 |
| 3,853,433 | 12/1974 | Roberts | 417/423 |

(List continued on next page.)

FOREIGN PATENT DOCUMENTS

| | | | | |
|---|---|---|---|---|
| 61-38181 | * | 2/1986 | (JP) | 417/902 |
| 2-173384 | * | 7/1990 | (JP) | 417/902 |

OTHER PUBLICATIONS

"The Thermodynamic Principles of Liquid Pressure Amplication And Liquid Injection," Hy–Save Corporate Headquarters (1991).

*Primary Examiner*—William Wayner
(74) *Attorney, Agent, or Firm*—Ken Richardson; Paul J. White

(57) ABSTRACT

The refrigeration system includes a compressor-pump unit and/or a liquid-injection assembly. The refrigeration system is a vapor-compression refrigeration system that includes an expansion device, an evaporator, a compressor, a condenser, and a liquid pump between the condenser and the expansion device. The liquid pump improves efficiency of the refrigeration system by increasing the pressure of, thus subcooling, the liquid refrigerant delivered from the condenser to the expansion device. The liquid pump and the compressor are driven by a single driving device and, in this regard, are coupled to a single shaft of a driving device, such as a belt-drive, an engine, or an electric motor. While the driving device may be separately contained, in a preferred embodiment, the liquid pump, the compressor, and the driving device (i.e., an electric motor) are contained within a single sealable housing having pump and driving device cooling paths to subcool liquid refrigerant discharged from the liquid pump and to control the operating temperature of the driving device. In another aspect of the present invention, a liquid injection assembly is included in a refrigeration system to divert liquid refrigerant from the discharge of a liquid pressure amplification pump to a compressor discharge pathway within a compressor housing to desuperheat refrigerant vapor to the saturation point within the compressor housing. The liquid injection assembly includes a liquid injection pipe with a control valve to meter the volume of diverted liquid refrigerant. The liquid injection assembly may also include a feedback controller with a microprocessor responsive to a pressure sensor and a temperature sensor both positioned between the compressor to operate the control valve to maintain the refrigerant at or near saturation.

31 Claims, 5 Drawing Sheets

U.S. PATENT DOCUMENTS

| | | | | |
|---|---|---|---|---|
| 4,086,033 | | 4/1978 | Stephan | 417/368 |
| 4,131,396 | | 12/1978 | Privon et al. | 417/372 |
| 4,325,679 | | 4/1982 | Smith | 417/372 |
| 4,419,865 | * | 12/1983 | Szmaszek | 62/DIG. 2 |
| 4,599,873 | | 7/1986 | Hyde | 62/498 |
| 5,139,394 | | 8/1992 | Aikawa | 417/356 |
| 5,404,964 | | 4/1995 | Zinsmeyer et al. | 184/6.12 |
| 5,525,039 | | 6/1996 | Sieghartner | 417/32 |
| 5,544,496 | | 8/1996 | Stoll et al. | 62/498 |
| 5,641,276 | | 6/1997 | Heidelberg et al. | 417/423.7 |
| 5,664,425 | | 9/1997 | Hyde | 62/90 |
| 5,666,814 | | 9/1997 | Yamamoto | 62/118 |
| 5,692,387 | * | 12/1997 | Alsenz et al. | 62/DIG. 2 |
| 5,694,780 | * | 12/1997 | Alsenz | 62/DIG. 2 |

* cited by examiner

REFRIGERATION SYSTEM WITH A COMPRESSOR-PUMP UNIT AND A LIQUID-INJECTION DESUPERHEATING LINE

CONTRACTUAL ORIGIN OF THE INVENTION

The United States Government has rights in this invention under Contract No. DE-AC36-83CH10093 between the United States Department of Energy and the National Renewable Energy Laboratory, a Division of the Midwest Research Institute.

BACKGROUND OF THE INVENTION

1. Field of the Invention

The present invention relates generally to vapor-compression refrigeration systems and more particularly to refrigeration systems utilizing a liquid pump to increase liquid refrigerant pressure between a condenser and an expansion device and to refrigeration systems having a liquid injection line to reduce superheat in the compressor discharge manifold and outlet stream. The present invention also relates to refrigeration systems utilizing a liquid refrigeration pump in any portion of the refrigeration system or circuit. Further, the present invention relates to a compressor-pump unit in which a liquid-refrigerant pump and a compressor are enclosed within a single, hermetically sealed housing and are coupled to a common shaft driven by a driving device which may also be enclosed within the housing.

2. Description of the Prior Art

In the United States and other countries, refrigeration systems are important for providing cooling in buildings and automobiles and in enabling safe and inexpensive food storage and transportation. The importance and number of refrigeration systems are continuing to grow with further industrialization and urbanization and as the growing population increases the demand for housing, automobiles, refrigerators, and similar products. The main purpose of a refrigeration system is to cool an enclosed space or medium to a lower temperature and to discharge absorbed heat into a higher temperature medium, such as air outside the enclosed space or other medium. To accomplish this type of cooling, it is necessary to do work on a refrigerant, such as ammonia or a halocarbon, to "pump" heat absorbed from the space being cooled into the higher temperature space.

In this regard, the most widely used refrigeration systems are compressor-driven (i.e., vapor-compression) refrigeration systems in which a compressor performs the work on the refrigerant. In typical vapor-compression refrigeration systems, cooling is achieved by passing a refrigerant through the following four basic components: an evaporator, a compressor, a condenser, and an expansion device or a valve. During operation, high pressure liquid refrigerant from the condenser passes through the expansion device, which reduces the pressure and the temperature of the liquid refrigerant. This low pressure. low temperature liquid refrigerant flows through the evaporator and evaporates as the refrigerant absorbs heat from air or liquids passing through or in heat exchange contact with the evaporator. The gaseous refrigerant is then drawn out of the evaporator by the compressor, which pumps the gaseous refrigerant to the condenser by raising the refrigerant pressure, and thus the refrigerant temperature. The gaseous refrigerant condenses to a liquid in the condenser as it gives up heat to a cooling medium that is passed through or in heat exchange contact with the condenser. The liquid refrigerant then flows to the expansion device where the cooling cycle begins again.

The efficiency or coefficient of performance (COP) of the vapor-compression refrigeration cycle can be measured as the ratio of heat absorbed in the lower temperature area to the amount of work that is put into the system, which, for the above system, would be the amount of energy required to operate the compressor.

While effective in providing cooling, a continuing concern with vapor-compression refrigeration systems has been the cost to initially purchase, to maintain, and to operate these refrigeration systems. A key component of the operating costs is the cost of energy for operating or driving the compressor. The cost of energy is generally the cost of electricity, because compressors are often driven by an electric motor, although internal combustion engines, steam turbines, and other driving devices may also be employed. To control or reduce energy costs, it is desirable to maintain and, more preferably, to increase the efficiency of the refrigeration system to obtain a desired amount of cooling at lower energy input levels, i.e., less work performed by the compressor. By increasing the efficiency of the refrigeration system, maintenance costs may also be improved as components, such as the compressor, are operated at conditions and at capacities more closely matching the conditions for which the components of the refrigeration system were designed and selected. With the widespread use of these refrigeration systems, refrigeration components and refrigeration systems having enhanced efficiency would be highly desirable in reducing the operating and maintenance cost of each system as well as resulting in a very large worldwide savings in operating (i.e., energy savings) and maintenance costs.

One method of increasing refrigeration system efficiency is to maintain the cooling levels or heat absorption levels while reducing the amount of work input to the refrigeration system by the compressor and other components. U.S. Pat. No. 4,599,873 issued to Hyde achieved a reduction in compressor work by reducing the required condensing pressure, i.e., the compressor output pressure, by installing a stand alone, liquid pump in the refrigeration system between the condenser outlet and the expansion device. The liquid pump inputs work to the system by boosting the liquid refrigerant pressure from the condenser thereby providing liquid refrigerant with more cooling capacity, i.e., subcooled liquid refrigerant to the expansion device. In the refrigeration industry, this concept has been labeled liquid pressure amplification (LPA) and has resulted, in a limited number of retrofit applications, in substantial energy savings, increased refrigeration capacities, and extended equipment, e.g., the compressor, service life as the compressor work input may be reduced to provide a condensing pressure that may be lower due to the use liquid pressure amplification.

However, the liquid pressure amplification concept as disclosed by Hyde has not been widely accepted by the refrigeration industry for use in either retrofitted or newly installed, private and industrial refrigeration systems. This lack of industry acceptance is due in part to the initial cost of the stand alone, liquid pump, which may double or at least significantly increase the cost of a vapor-compression refrigeration system. The high cost of the stand alone, liquid pump is due in part to the need for a durable unit that is sealable to prevent refrigerant leakage. Hyde discloses a design having a pump driven by a motor with both the pump and the motor being separately sealed in housings to prevent leakage and contamination of the refrigerant stream in the event of a motor failure. While this liquid pressure amplification design effectively reduces energy costs, the air conditioning and refrigeration industry is highly competitive on initial or installation costs and skeptical of non-mainstream technology, which often requires customizing of existing refrigeration systems and support equipment. Therefore, widespread adoption of liquid pressure amplification for new refrigeration system applications and for retrofit of existing refrigeration systems will probably not occur until a lower cost implementation of this energy saving concept is discovered.

Other efforts toward increasing refrigeration system efficiency have been directed toward increasing the efficiency of the condenser. The function of the condenser is to receive higher pressure, higher temperature gaseous refrigerant from the compressor, to condense the gaseous refrigerant, and to output liquid refrigerant. Generally, the compressor outputs gaseous refrigerant that is superheated or, in other words, contains more heat at a given pressure than would be expected of that particular gaseous refrigerant if the refrigerant was saturated vapor. Therefore, the first portion of the condenser, for example the first 30 percent, must be utilized to remove this extra heat, i.e., to desuperheat the refrigerant vapor to obtain saturated vapor at a given pressure, prior to removing the heat necessary to condense the refrigerant to liquid. To compensate, condensers with large or excess capacity are often employed to condense the superheated refrigerant vapor, thereby adding to the cost of the refrigeration systems.

In an attempt to resolve this inefficiency, U.S. Pat. No. 5,664,425 issued to Hyde discloses a refrigeration system employing liquid pressure amplification (LPA) but designed to try to reduce the temperature of the refrigerant vapor prior to the condenser inlet. This system includes a branch conduit from the stand alone liquid pump discharge line to divert liquid refrigerant into the inlet pipe of the condenser. The lower temperature liquid refrigerant acts to cool or remove heat from the refrigerant vapor before the refrigerant vapor enters the condenser. In this manner, the condenser receives the refrigerant vapor at a lower temperature at which the refrigerant vapor may or may not be desuperheated to saturation, and the condenser's efficacy is increased as more of the condenser volume may be utilized in condensing the refrigerant vapor.

However, the bypass-conduit system disclosed by Hyde has several limitations which have limited its implementation in vapor-compression refrigeration systems. For example, this Hyde system is designed for installation in existing systems after the completion of extensive, and often expensive, analysis of the particular system's operating parameters, including the specific refrigerant being used and the condenser inlet temperatures and pressures. The amount of liquid refrigerant to be diverted may then be calculated from this and other system specific data, and the control of the volume of diverted liquid refrigerant is achieved by selecting a fixed orifice and/or diameter of the bypass conduit. While Hyde's bypass-conduit system has the potential of increasing the efficiency of the analyzed and retrofitted system, the sizing of a bypass conduit for the millions of existing refrigeration systems may not be practical and may make the system only suitable for retrofitting high operating cost refrigeration systems for which the high costs of individualized analysis, design, and customization of the system may be economically justifiable. Further, a fixed-size bypass conduit does not accommodate changing system pressures and temperatures as is desirable in existing, as well as yet to be built, refrigeration units that operate in a wide range of outdoor temperatures and cooling load conditions.

Consequently, in spite of the above discussed efforts to improve vapor-compression refrigeration system efficiency, there is still a need for refrigeration system methods and apparatus which improve the operating efficiency of refrigeration systems employing a wide variety of refrigerants and equipment, such as compressors and condensers, at an acceptable initial cost and with a technical design that is acceptable to the refrigeration industry, i.e., technology that is perceived as mainstream for the refrigeration industry and that is readily useful in typical refrigeration applications.

SUMMARY OF THE INVENTION

Accordingly, it is a general object of the present invention to provide a refrigeration system with improved performance and efficiency.

A more specific object of the present invention is to provide a refrigeration system with a liquid pressure amplification pump between a condenser outlet and an expansion device inlet at an improved cost.

It is a related object of the present invention to provide a refrigeration system with a liquid pressure amplification pump having a design that is acceptable to the refrigeration industry as technically mainstream and readily useable with existing and planned refrigeration system designs.

It is another specific object of the present invention to provide a refrigeration system with improved condenser efficiency.

It is a related object of the present invention to provide a refrigeration system with improved condenser efficiency that is operable with the standard refrigerants used by the refrigeration industry without adaptation for each refrigerant.

It is an additional related object of the present invention to provide a refrigeration system with improved condenser efficiency that is operable for a wide range of operating conditions, including changing system pressures and external temperatures, without adaptation for each operating condition.

Additional objects, advantages, and novel features of the invention are set forth in part in the description that follows and will become apparent to those skilled in the art upon examination of the following description and figures or may be learned by practicing the invention. Further, the objects and the advantages may be realized and attained by means of the instrumentalities and in combinations particularly pointed out in the appended claims.

To achieve the foregoing and other objects and in accordance with the purposes of the present invention, as embodied and broadly described herein, the refrigeration system is a vapor-compression refrigeration system with refrigerant flowing through a compressor, a condenser, an expansion device, and an evaporator and including a liquid pump driven by a shaft of a driving device that is also utilized to operate the compressor. The compressor, liquid pump, and driving device form a compressor-pump unit of the present invention. The use of only one driving device for the compressor and liquid pump improves component cost as only one driving device, e.g., an electric motor, needs to be provided and to be sealed from the flowing refrigerant. During operation, the liquid pump receives liquid refrigerant from the condenser and discharges the liquid refrigerant at a higher pressure, thereby reducing the amount of work that must be performed by the compressor under certain ambient conditions, e.g., the compressor outlet pressure, and thus the condenser pressure, may be lower to achieve the same cooling by the refrigeration system. The liquid pump and compressor may be contained in separate housings or, more preferably, may be semi-hermetically or hermetically sealed within a single housing. The driving device may be an external device, such as a belt-drive system or an electric motor, coupled to a portion of the shaft external to the compressor and/or liquid pump housing(s). Alternatively, the driving device, i.e., an electric motor, the liquid pump, and the compressor may be contained within a single housing.

A single housing design provides additional advantages of the refrigerant system of the present invention. The single housing design controls spacing requirements as all three components are contained in a housing which in previous refrigeration systems would have only contained a driving device, i.e., electric motor, and a compressor. Additionally, the single housing design improves system costs as only one housing needs to be provided and sealed against refrigerant leakage. Further, the single housing design may be configured such that refrigerant vapor flowing within the housing provides useful cooling. For example, the housing may be configured to have a pump cooling pathway that causes refrigerant vapor received from the evaporator to contact the pump casing and outlet piping to cool the higher temperature liquid refrigerant within the pump. In this manner, the liquid refrigerant is discharged at a lower temperature and an improved cooling capacity to the expansion device, thereby improving the overall capacity of the refrigeration system. Additionally, the housing may be configured to include a driving device cooling pathway that directs refrigerant vapor over the exterior of the driving device to cool the driving device which increases the service life of the driving device and alleviates the need for additional cooling components or methods.

To further achieve the foregoing and other objects, the present invention further comprises a vapor-compression refrigeration system with liquid injection desuperheating including a compressor, a condenser, an expansion device, an evaporator, and a liquid pump interposed between the condenser and the expansion device to increase liquid refrigerant pressure delivered to the expansion device from the condenser. The refrigeration system further includes a liquid injection assembly to divert a volume of liquid refrigerant discharged from the liquid pump to a compressor outlet manifold or discharge pathway within a compressor housing to cool or desuperheat a higher temperature refrigerant vapor discharged from the compressor to a saturation point, thereby improving the efficiency of the condenser by reducing the amount of superheat the condenser needs to remove before condensing the refrigerant vapor. Additionally, in this manner, cooler refrigerant is discharged from the compressor housing reducing the need for external cooling devices, such as fans and water jackets, for the compressor housing and compressor discharge valves, and compressor cylinder heads. Because the outlet of the liquid pump is the highest pressure point in the refrigeration system, the liquid injection assembly may include only a liquid injection pipe section or conduit having a diameter selected to meter liquid refrigerant flow to the compressor discharge pathway. This simple design may be preferable for use with a compressor-pump unit in which the liquid pump and compressor are sealed within a single housing. In this embodiment, the liquid injection pipe has an inlet on the liquid pump discharge port or line within the housing and an outlet on the compressor discharge manifold or discharge pathway within the housing.

To accommodate the use of various refrigerants and changing operating conditions, the liquid injection assembly may further include a control valve to meter the flow of liquid refrigerant into the compressor discharge pathway. The control valve may include a microprocessor, and to further improve precision and control, the liquid injection assembly may include a pressure sensor and a temperature sensor communicatively linked to the microprocessor. The pressure sensor may be positioned to sense the pressure of the refrigerant vapor downstream of a liquid injection pipe section outlet. The temperature sensor may be positioned at any point between the compressor housing and the condenser to sense the temperature of the refrigerant vapor prior to a condenser inlet. The microprocessor preferably stores in memory the saturation temperatures and pressures corresponding to refrigerants that may be used within the refrigerant system. With this stored information, the feedback controller and control valve may be operated based on a comparison performed by the microprocessor between received pressure and temperature signals and the stored values for a particular refrigerant. As an illustration, when a pressure signal is received the microprocessor may retrieve an expected saturation temperature for the refrigerant being used based on this pressure signal and then compare the retrieved, expected saturation temperature to a temperature signal corresponding to the refrigerant vapor received from the temperature sensor. Based on the results of this temperature comparison, the microprocessor may operate the feedback controller and control valve to increase, decrease, or maintain the present liquid refrigerant flow to attempt to maintain the refrigerant vapor being discharged from the compressor housing at or near the saturation point.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
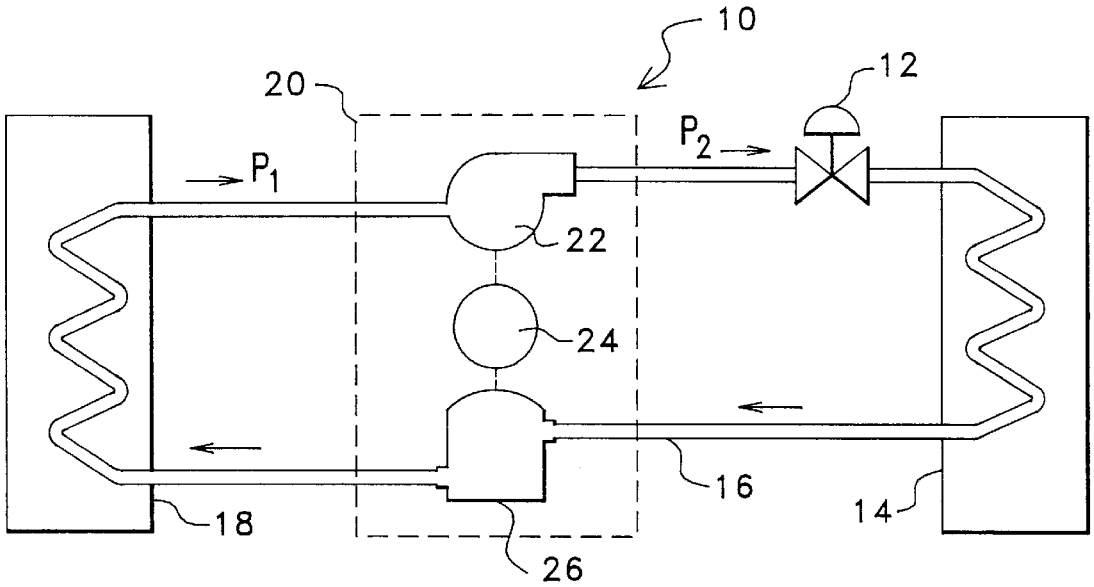
FIG. 1 is a schematic diagram of a vapor-compression refrigeration system of the present invention.

A vapor-compression refrigeration system 10 according to the present invention is illustrated schematically in FIG. 1. The refrigeration system 10 includes an expansion device 12, an evaporator 14, refrigerant piping 16 to enable refrigerant (i.e., ammonia, halocarbons, and other refrigerants suitable for vapor-compression refrigeration systems) flow, a condenser 18, and a compressor-pump unit 20 comprising a liquid pump 22, a driving device 24 and a compressor 26. To understand the inventive elements of the present invention, it is helpful to first generally understand the operation of the refrigeration system 10. During cooling operations by the refrigeration system 10, a liquid refrigerant flows through refrigerant piping 16 from the expansion device 12 to the evaporator 14 where heat is absorbed by the refrigerant causing the refrigerant to exit as a vapor or gas that is saturated or, more likely, superheated (i.e., the refrigerant absorbed more heat than required to change from a completely liquid to a completely gaseous form). Next, the low pressure, low temperature refrigerant is received by the compressor-pump unit 20 in which the compressor 26 inputs energy into the refrigerant by increasing the pressure, and concurrently, the temperature, of the refrigerant. The higher pressure, higher temperature gas is discharged from the compressor 26 of the compressor-pump unit 20 and enters the condenser 18 which removes heat from the refrigerant to take the refrigerant from a superheat state to a saturation state at which point the refrigerant vapor begins to condense. Ideally, the condenser 18 then continues to remove heat from the refrigerant to completely condense the refrigerant to a saturated liquid (i.e., liquid substantially free of vapor). The liquid refrigerant is discharged from the condenser at a condensing pressure, $P_1$, and enters the compressor-pump unit 20. The liquid pump 22 adds energy to the liquid refrigerant by increasing the liquid refrigerant pressure (i.e., liquid pressure amplification (LPA)) incrementally up to a pump discharge pressure, $P_2$. In this maimer, the liquid pump 22 discharges liquid refrigerant to the expansion device 12 that is subcooled, i.e., contains more cooling potential than saturated liquid refrigerant, and the cooling operation or cycle is repeated. As may be understood by those skilled in the art, by including the liquid pump 22, the refrigeration system 10 may be operated at a lower condensing pressure, $P_1$, and a corresponding lower condensing temperature and with less work input by the compressor 26, both of which may significantly improve the efficiency of the refrigeration system 10 and reduce wear of the compressor 26.

Figure 2:
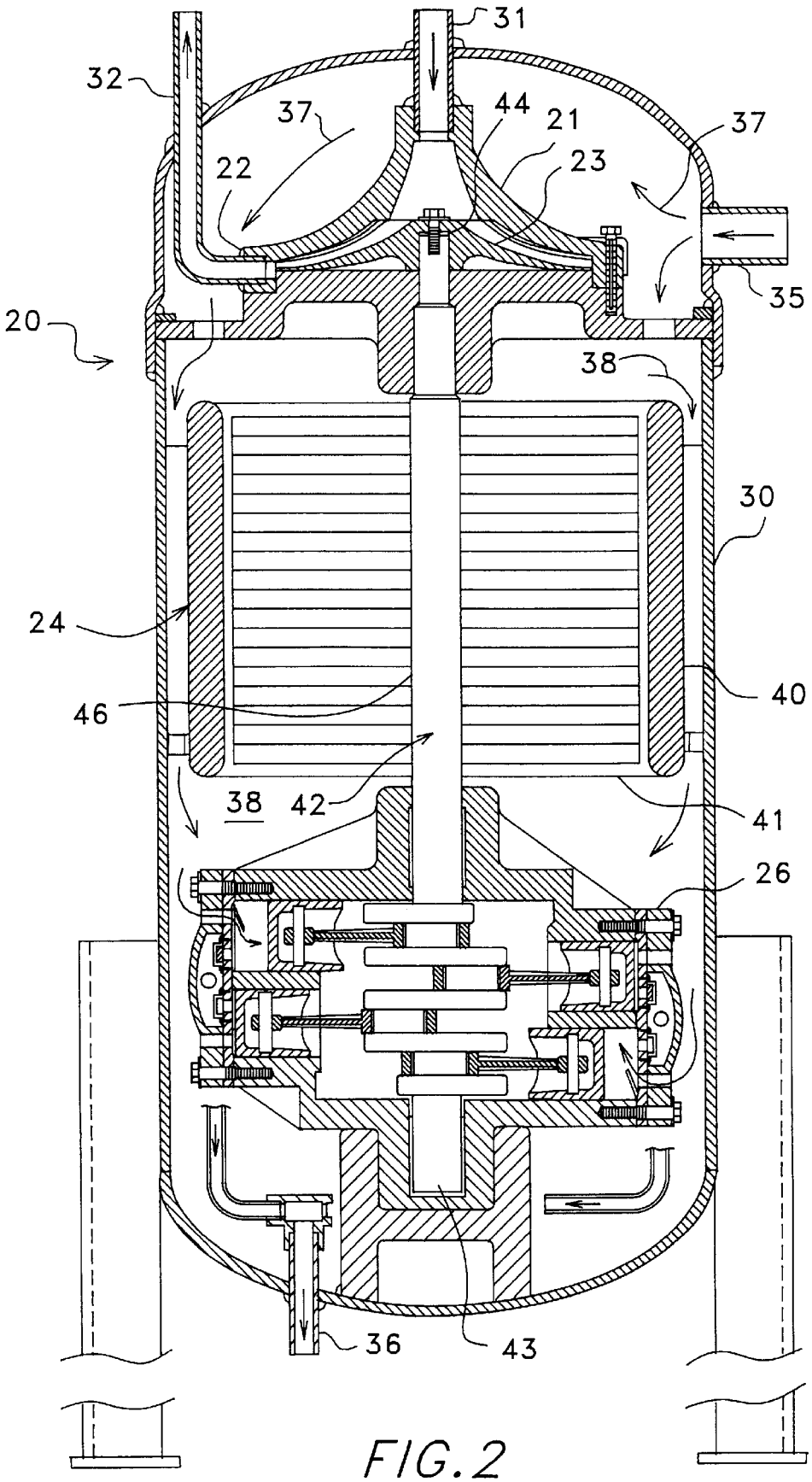
FIG. 2 is a cross-sectional view of a single housing embodiment of a compressor-pump unit of FIG. 1.

While liquid pressure amplification improves the efficiency, thus reducing operating and maintenance costs, of the refrigeration system 10, the initial cost of previous designs has been relatively high and may need to be significantly reduced for liquid pressure amplification to become widely accepted and used by the refrigeration industry. In this regard, one of the significant features of the present invention is the use of only one driving device 24 in the compressor-pump unit 20 to drive or operate both the liquid pump 22 and the compressor 26. In the past, a pump and a separate driving device, e.g., an electric motor, were employed. Such stand alone pump designs have not been widely implemented, in part, because such stand alone pump designs require expenditure not only for a pump but also for an additional driving device with corresponding containment or sealing from the refrigerant to avoid contaminating the refrigerant, as well as pump sizing and capacity synchronization and controls that are initially expensive. In contrast, as shown in FIG. 2, the compressor-pump unit 20 of the present invention provides for the operation of the liquid pump 21 and the compressor 26 with a common, single driving device 24 that does not require additional synchronization or controls. The combining of the liquid pump 21, the compressor 26, and the driving device 24 enables liquid pressure amplification to be included in refrigeration systems at a much lower initial cost than prior designs. In addition, the compressor-pump unit 20 of the present invention provides a number of other benefits, including enhanced cooling efficiency and improved space requirements, that will become clear from the following description.

Figure 3:
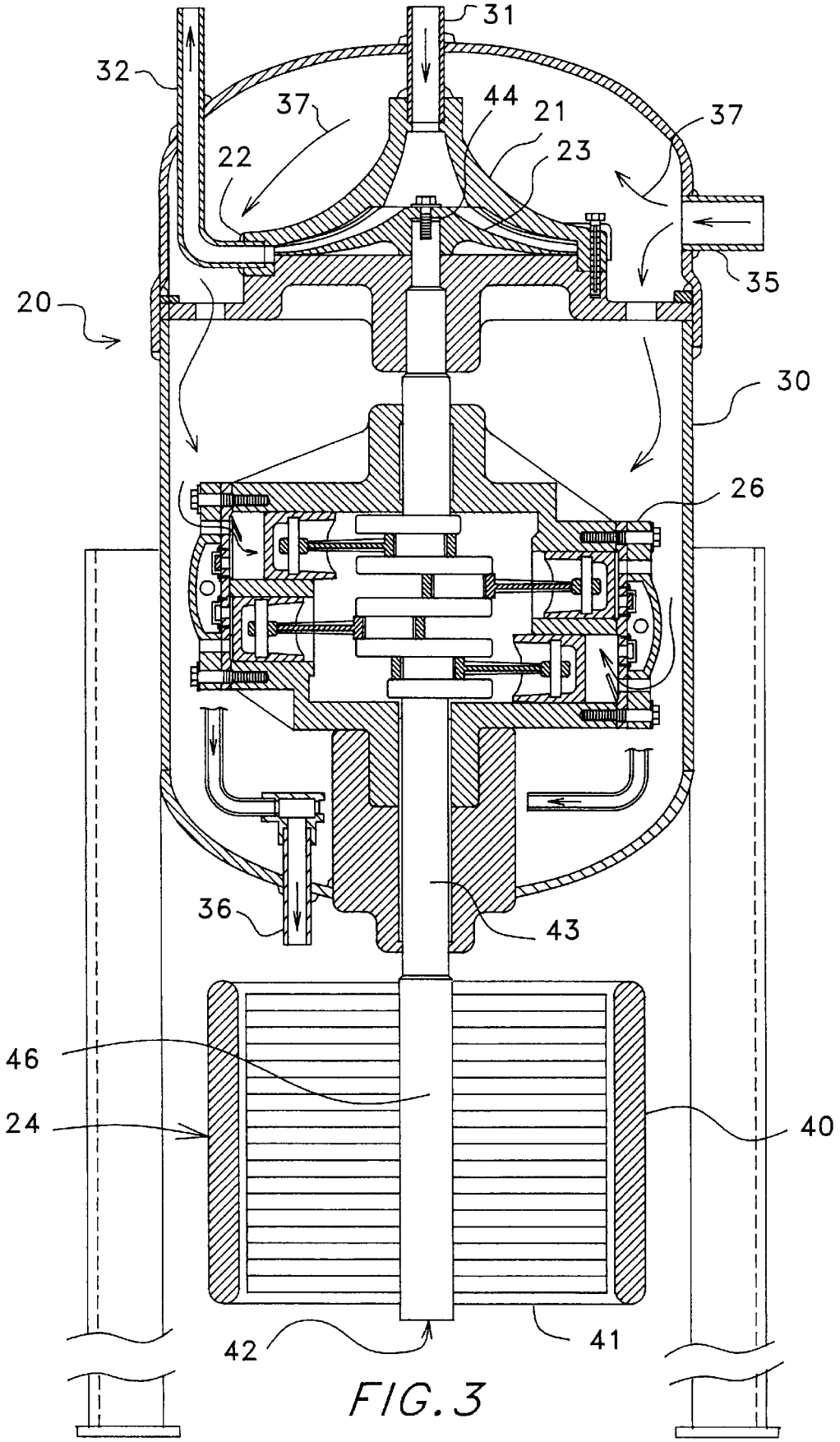
FIG. 3 is a cross-sectional view of an external drive device embodiment of a compressor-pump unit of FIG. 1.

Referring again to FIG. 2, the compressor-pump unit 20 includes a driving device 24 with a shaft 42 for concurrently operating the liquid pump 21 and the compressor 26. To achieve this concurrent operation, the shaft 42 of the driving device comprises three portions: a first portion 43 interconnected with the compressor 26, a second portion 44 coupled to rotating portions of the pump 21 (e.g., as illustrated, impeller 23), and a third portion 46 which is rotated within the driving device 24 at a speed selected for proper operation of both the liquid pump 21 and the compressor 26. To provide the desired shaft rotation, the driving device 24 may take many forms, including, for example, a belt drive system, a steam turbine, a fossil fuel engine, and an electric motor. As illustrated, the driving device 24 comprises an electric motor 40 with a rotor 41 rigidly coupled with the third portion 46 of the shaft 42. While the electric motor 40 is shown in FIG. 2 to be interposed between the pump 21 and the compressor 26, it should be understood that the driving device 24 may readily be positioned on one end of the shaft 42. For example, an embodiment of the present invention is shown in FIG. 3 in which the electric motor 40 is mounted on an end (third portion 46) of the shaft 42.

Several advantages are recognized by mounting the components of the compressor-pump unit 20 on a single shaft 42. A single driving device 24 can drive the liquid pump 21 and the compressor 26 to reduce initial costs and ongoing maintenance and operating costs. Additionally, the compressor-pump unit 20 may include a containment vessel or housing to enclose one or more components to increase the durability of the components, to effectively and inexpensively seal refrigerant within the refrigeration system 10, and to obtain desirable heat transfer between flowing refrigerant and compressor-pump unit 20 components, such as the liquid pump 21 and the driving device 24. In FIG. 2, the compressor-pump unit 20 includes a sealable housing 30 enclosing and supporting the liquid pump 21, the driving device 24, and the compressor 26. In another design according to the present invention, the compressor-pump unit 20 may include a sealable housing 30 that houses the liquid pump 21 and the compressor 26, as shown in FIG. 3. Further, a compressor-pump unit housing maybe configured to house a liquid pump and a driving device with a shaft interconnecting a separately housed compressor or be configured to house a compressor and a driving device with shaft interconnecting a separately housed liquid pump.

Referring again to FIG. 2. the housing 30 functions as a protective containment for the liquid pump 21, the driving device 24, and the compressor 26. This containment may be advantageously achieved with an overall vessel or containment size that is equivalent or slightly larger than currently utilized compressor and motor housings. Because many refrigeration systems are designed for applications with limited space, such as for automobiles, the improved size requirements of the present invention make the compressor-pump unit 20 readily applicable for retrofitting existing refrigeration systems and for systems that will be designed and built for restricted space applications.

Additionally, the housing 30 directs refrigerant flow and includes a refrigerant inlet 31 and a refrigerant outlet 32 for the liquid pump 21, and further includes a refrigerant inlet 35 and a refrigerant outlet 36 for the compressor 26. Liquid refrigerant from the condenser 18 flows through the refrigerant inlet 31 to the liquid pump 21 which inputs energy with impeller 23 and discharges the higher pressure, subcooled liquid refrigerant through a discharge port 22 and the refrigerant outlet 32. While a single-stage, centrifugal pump is illustrated, it should be understood that multistage, centrifugal pumps and other types of pumps, including rotary and reciprocating pumps, may be successfully utilized as part of the compressor-pump unit 20 of the present invention. As discussed above, low temperature, low pressure refrigerant vapor flows from the evaporator 14 to the compressor-pump unit 20. The refrigerant vapor enters through the refrigerant inlet 35 flows into the compressor 26 and is compressed to a higher pressure and higher temperature before being discharged out the refrigerant outlet 36 to flow to the condenser 18. As with the liquid pump 21, many types of shaft-driven compressors that may be utilized to successfully practice the compressor-pump unit 20 of the present invention. in this regard, the compressor 26 may be a reciprocating compressor as shown or may be, for example, a centrifugal, screw or scroll compressor. Although not shown. the housing 30 may also be configured to house other support equipment, such as an oil cooler for the compressor 26.

Another important feature of the housing 30 of the compressor-pump unit 20 is that the housing 30 enables low temperature refrigerant vapor from the evaporator to be used to effectively cool the pump 21 and the driving device 24 prior to entering the compressor 26. The refrigerant vapor entering the housing 30 at the refrigerant inlet 35 will be at temperatures significantly lower than the liquid refrigerant within the pump 21. This large temperature differential enables heat to be transferred from the higher temperature liquid refrigerant to the lower temperature refrigerant vapor by passing the refrigerant vapor over the pump 21 and the pump refrigerant outlet 32. By reducing the temperature of the liquid refrigerant flowing from the housing 30 to the expansion device 12, the cooling potential of the refrigerant is increased because the liquid refrigerant is subcooled beyond the subcooling provided by the added pressure from the liquid pump 21. As will be understood by those skilled in the art, a variety of heat transfer methods may be utilized to achieve this desired additional subcooling. As illustrated, a pump cooling pathway 37 in the housing 30 is used to direct the lower temperature refrigerant vapor to flow over, and contact, the pump 21 and refrigerant outlet 32. This effectively results in heat being passed from the higher temperature liquid refrigerant within the pump 21 and refrigerant outlet 32 to the flowing lower temperature refrigerant vapor. Although not shown, alternative methods of heat transfer may include increasing the heat transfer area (e.g., varying the outer shape of the pump 21 and/or creating a path 37, such as a tube wrapped around the pump 21, that increases the contact area) and using cross-flow to maintain a higher temperature differential (i.e., lower temperature refrigerant vapor entering near a point the liquid refrigerant is exiting the housing 30). FIG. 3 illustrates how a pump cooling pathway 37 may be included in a housing 30 that houses a pump 21 and a compressor 26 with an external driving device 24. Referring again to FIG. 2, to cool the electric motor 40 of the driving device 24, the housing 30 includes a motor cooling pathway 38 to direct refrigerant vapor about the peripheral surfaces of the electric motor 40 to cool the electric motor 40 to a preferred operating temperature for an extended service life. In this manner, the use of one driving device 24 and shaft 42 enables the housing 30 to be uniquely designed to structurally support and contain the liquid pump 21, the driving device 24, and the compressor 26, and further, to effectively cool the driving device 24 and refrigerant within the liquid pump 21.

Additionally, the housing 30 may be designed to provide structural features of the housed components. In this regard, although not illustrated, the housing 30 may be configured to provide a pump casing for the liquid pump 21, a discharge manifold for the compressor, and other useful structures. To provide these structures, the housing 30, or a portion thereof, may be molded to contain the desired features or structures. For example, but not as a limitation, the housing 30 may be molded with a pump volute as one end portion and a compressor discharge manifold for a scroll compressor as the opposite end portion. As will be apparent to those skilled in the art, the specific molded design of the housing 30 may readily be adapted to match the specific compressor and pump types selected and the physical arrangement of these components within the housing.

Another significant aspect of the present invention is the injection of liquid refrigerant from a liquid pressure amplification pump into high temperature, high pressure refrigerant vapor at the compressor discharge, i.e., within the compressor discharge manifold or discharge line within the compressor housing. This use of the discharge of the liquid pressure amplification pump provides a vapor-compression refrigeration system in which refrigerant vapor at or near the saturation point (i.e., refrigerant vapor at substantially the compressor discharge pressure but at a lower temperature) is delivered to a condenser. Delivering saturated refrigerant vapor to a condenser inlet results in improved condenser efficiency as nearly all of the condenser volume may be used in removing heat to condense the refrigerant vapor to liquid rather than initially removing superheat simply to obtain a saturated vapor. Further, the condenser may be operated at a lower condensing temperature which is desirable to improve service life and heat transfer efficiency by controlling scale formation on condenser surfaces and surface degradation that occurs more rapidly at higher condensing temperatures.

As discussed above, the injection of the liquid refrigerant, and thus desuperheating, preferably occurs within the compressor discharge manifold or discharge line prior to the high temperature, high pressure refrigerant being discharged from the compressor housing or containment. This liquid injection location is important in reducing the operating temperature of the compressor, the compressor housing, and any included compressor discharge controls, such as discharge valves. Lower operating temperatures for these components are desirable for extending the service life of the compressor and the discharge valve. Additionally, external cooling, in the form of head cooling fans, water jackets, and the like, may not be required in applications that currently require cooling, such as refrigeration applications in which the compressor housing is positioned in an enclosed area or adjacent to temperature sensitive equipment. Therefore, use of the present invention may reduce design, equipment. and maintenance costs. Further cost and space savings may be realized because the reduction of the temperature within the compressor discharge manifold and housing may allow oil coolers, generally used with refrigeration system compressors, to be reduced in size and capacity.

Figure 4:
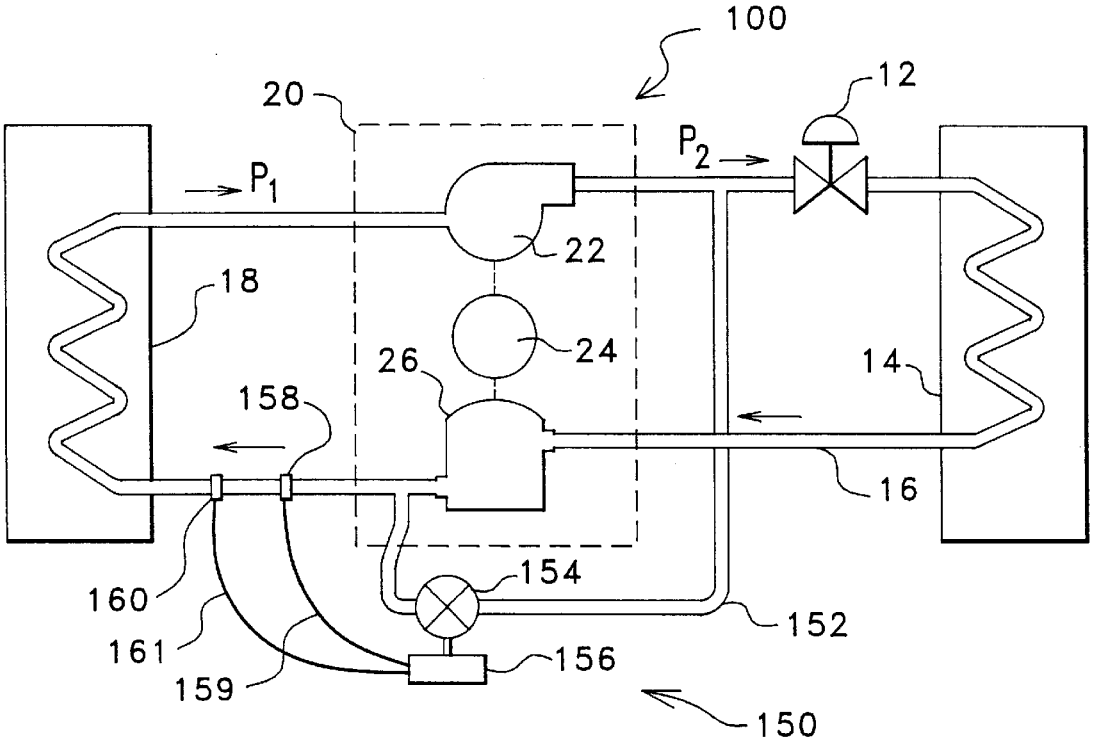
FIG. 4 is a schematic diagram of a vapor-compression refrigeration system utilizing desuperheating according to the present invention and including a liquid injection assembly.

FIG. 4 illustrates schematically a vapor-compression refrigeration system 100 including a liquid injection assembly 150 to desuperheat the compressor 26 discharge within the compressor 26 discharge pathway. The liquid injection assembly 150 may be relatively simple in design, containing only a liquid injection pipe section 152 because the liquid pump 22 discharge pressure, $P_2$, is the highest pressure in the refrigeration system 100, thus enabling injection of the higher pressure liquid refrigerant into the compressor 26 discharge pathway.

Figure 5:
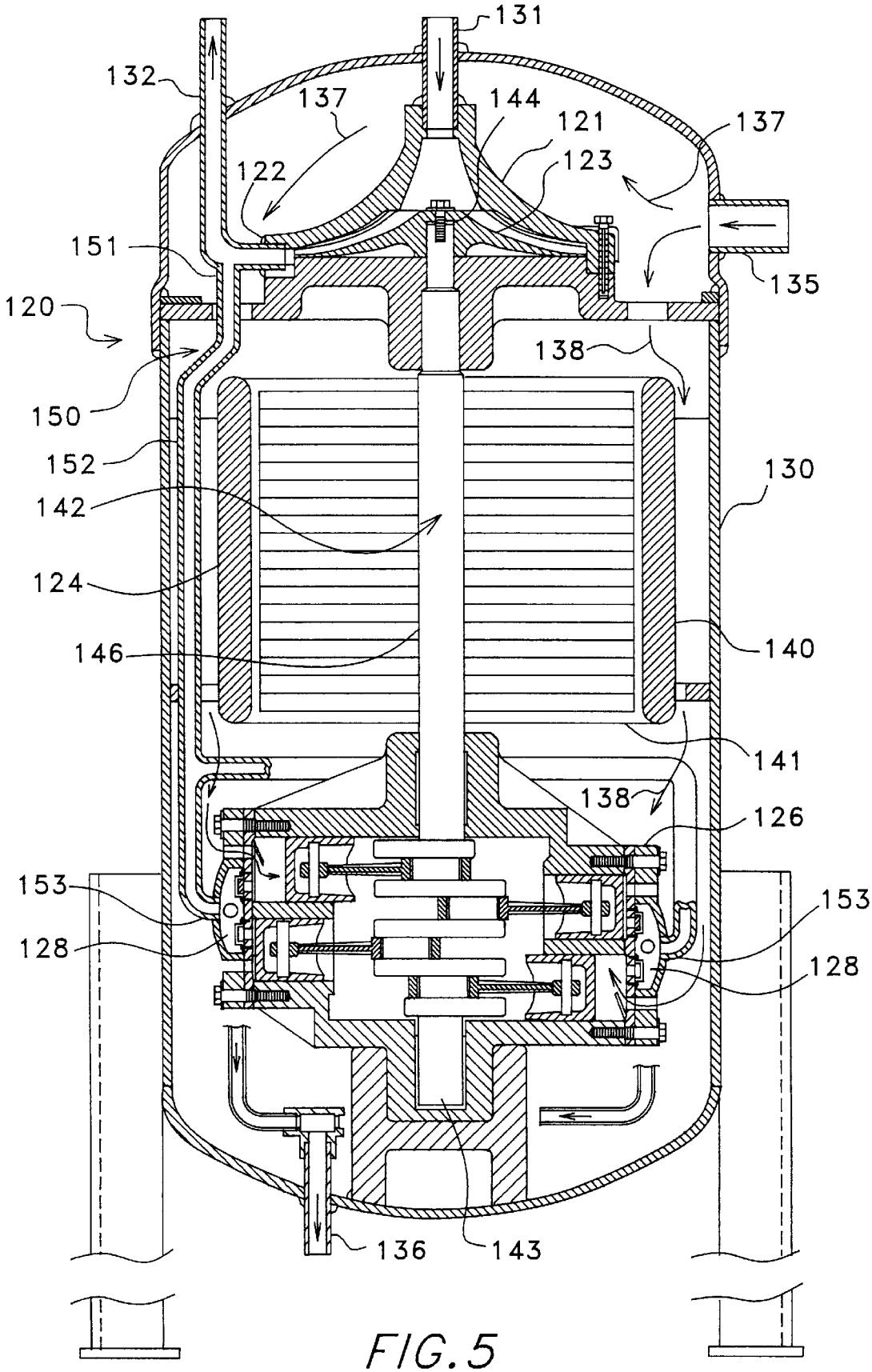
FIG. 5 is a cross-sectional view of a compressor-pump unit of FIG. 4 including a liquid injection assembly.

In this regard and referring to FIG. 5, a preferred embodiment of a compressor-pump unit 120 including a liquid injection assembly 150 is illustrated. The containment of the liquid injection assembly 150 within the housing 130 improves durability and also, provides a compressor-pump unit 120 with desuperheating that has similar external dimensions and appearance to existing compressor and motor vessels, which may facilitate placement of the compressor-pump unit 120 within existing refrigeration systems and within systems yet to be fabricated. The liquid injection pipe section 152 has an inlet 151 downstream from the outlet port 122 of the liquid pump 121 within the housing 130. Liquid refrigerant flows from the inlet 151 through the liquid injection pipe section 152 to outlets 153 located in a discharge pathway 128 of compressor 126. The volume of refrigerant flow is controlled by selecting an inner diameter for the liquid injection pipe section 152 based. at least in part, upon anticipated operating pressures and a calculated pressure differential between the liquid pump 121 and the compressor 126, operating system and external temperatures, and expected refrigerants for the compressor-pump unit 120. The specific location and number of outlets 153 may be varied to desuperheat compressor discharges and to cool the compressor 126 and will depend upon the compressor types used. Similarly, the outlets 153 may be located in a discharge manifold or discharge piping to achieve many of the benefits of the present invention.

As will be clear to those skilled in the art, it may be preferable that liquid injection assembly 150 be operable to actively monitor and control whether a proper volume of liquid refrigerant is injected to desuperheat refrigerant vapor being fed to condenser 18. This may be desirable to account for varying operating conditions, such as changes in external temperatures, and to account for operating ranges of included refrigeration equipment. Because each vapor, here refrigerant vapor, has a saturation temperature corresponding to each pressure, the measurement of the pressure and/or the temperature of the refrigerant vapor after injection of the lower temperature, liquid refrigerant and also at, or before, the condenser 18 inlet enables the maintenance of the refrigerant vapor at or near saturation through desuperheating by injecting a volume of liquid refrigerant to match sensed refrigerant temperature (i.e., actual refrigerant temperature) to a saturated temperature value corresponding to a sensed refrigerant pressure.

Figure 6:
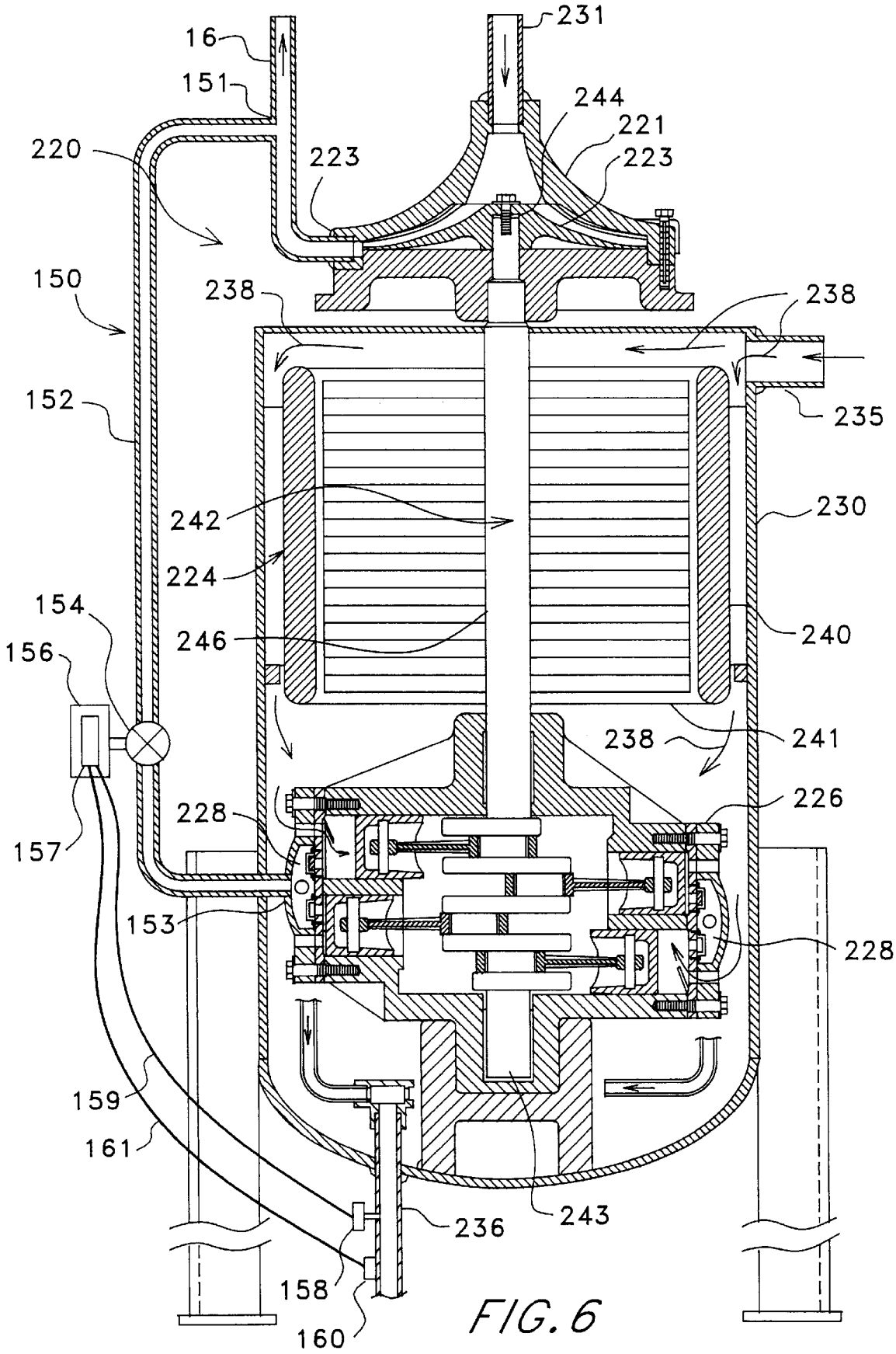
FIG. 6 is a cross-sectional view of a compressor-pump unit of FIG. 4 showing separate pump and compressor housings and a liquid injection assembly.

In this regard, a simple feedback controller may be employed to operate a valve in the liquid injection pipe section 152 based on pressure signals and/or temperature signals received from sensors positioned downstream of the liquid refrigerant injection point and from sensors positioned further downstream or near the condenser 18. Referring to FIGS. 4 and 6, liquid injection assembly 150 includes a control valve 154 in the liquid injection pipe section that is operated by a feedback controller 156 to control or meter the volume of lower temperature, liquid refrigerant that flow through the liquid injection pipe section 152. FIG. 6 illustrates a compressor-pump unit 220 in which a liquid pump 221 is housed separately from compressor 226 and driving device 224, both of which are housed within housing 230. Driving device 224 includes a shaft 242 for driving both the liquid pump 221 and the compressor 226 concurrently.

Although every combination of a pump, a compressor, and a driving device(s) is not shown, it should be understood that the liquid injection assembly 150 illustrated in FIG. 6 may be successfully implemented in any refrigeration system which includes a liquid pressure amplification pump and a compressor, whether or not a single driving device is utilized. Referring again to FIG. 6, lower temperature, higher pressure liquid refrigerant enters the liquid injection pipe section 152 at inlet 151 downstream of outlet port 223 of liquid pump 221 and on refrigerant piping 16. The liquid refrigerant flows through control valve 154 to outlet 153 of the liquid injection pipe section 152. The liquid injection pipe section 152, or at least the outlet 153, sealably penetrates the housing 230 to enable the liquid refrigerant to be injected within the compressor discharge pathway 228. Although shown in FIG. 6 as a portion of the compressor 226, the compressor discharge pathway 228 may comprise any flow path for the discharged refrigerant gas between an outlet port (i.e., downstream from discharge valves of a compressor) on the compressor 226 and the refrigerant outlet 236 in the housing 230. To provide cooling to the compressor 226, it may be preferable that the outlet 153 be positioned relatively near to the compressor 226 outlet port(s) with specific location depending upon the type of compressor utilized and the specific configuration of the containing vessel used to house the compressor. To illustrate, many compressor vessel designs include threaded connections near the compressor discharge which may be successfully utilized as an inlet for liquid injection.

The liquid injection assembly 150 includes feedback controller 156 that is communicatively linked by signal lines 159 and 161, respectively, to pressure sensor 158 and temperature sensor 160. Pressure sensor 158 may be positioned at any location between the outlet 153 of the liquid injection pipe section 152 and the condenser 18 inlet. The pressure sensor 158 operates to detect the pressure of the refrigerant vapor after the desuperheating liquid refrigerant has been injected into and mixed with the refrigerant vapor discharged from the compressor 226. The pressure sensor 158 then transmits a corresponding signal via signal line 159 to the feedback controller 156. The temperature sensor 160 similarly may be positioned at a number of locations downstream from the refrigerant outlet 236 in the housing 230 to sense refrigerant vapor temperature and transmit a corresponding signal via signal line 161 to the feedback controller 156. Preferably, the temperature sensor 160 may be positioned near the condenser 18 inlet to sense the temperature of refrigerant vapor entering the condenser 18. The feedback controller 156 then compares the received temperature signal from the temperature sensor 160 to a saturation temperature for the refrigerant corresponding to the pressure signal received from the pressure sensor 158. The feedback controller 156 then operates the control valve 154 as appropriate to change the temperature of the refrigerant vapor to the saturation temperature corresponding to pressure sensed by pressure sensor 158, and in this manner, the refrigerant vapor is maintained at or near saturation as it enters the condenser 18 improving the efficiency of the condenser 18 over a wide range of condensing, i.e., compressor outlet, pressures. Feedback controller devices, temperature sensors, and pressure sensors are well-known in the refrigeration industry, and this generally known equipment may be employed to successfully practice the present invention.

Additionally, the feedback controller 156 may contain a microprocessor 157 to allow effective control of the control valve 154 and monitoring of the liquid injection assembly 150 operation. The microprocessor 157 preferably includes a memory for storing saturation pressures and corresponding saturation temperatures for at least one refrigerant, and more preferably for all refrigerants which are anticipated to be used in connection with the liquid injection assembly 150. With these values in memory, the microprocessor 157 preferably is configured to enable a user to input via a menu on a monitor (not shown) or switching device (not shown) the refrigerant that is utilized in the refrigeration system 100 in which the liquid injection assembly 150 is installed. This switching-memory feature facilitates the use of the liquid injection assembly 150 of the present invention with any standard refrigerant without requiring programming or adaptation for each refrigerant or system. In operation, the microprocessor 157 receives a pressure signal from the pressure sensor 158 via signal line 159. The microprocessor 157 uses this pressure signal to retrieve a saturation temperature based on a user input refrigerant. A temperature signal is then received by the microprocessor 157 from the temperature sensor 160 via signal line 161. The microprocessor 157 compares the received temperature signal to the retrieved saturation temperature and signals the feedback controller 156 to operate the control valve 154 to throttle open or close, such that liquid refrigerant flow into the compressor discharge pathway 228 desuperheats the refrigerant vapor to saturation. This monitoring operation may be repeated at predetermined periods of time to account for changing operating conditions, with the period of time being adjustable based on the particular refrigeration application, for example, short periods (e.g., nearly continuous adjustment/throttling of control valve 154) for refrigeration systems that experience more rapid changes in operating temperatures and/or pressures.

The foregoing description is considered as illustrative only of the principles of the invention. Furthermore, since numerous modifications and changes will readily occur to those skilled in the art, it is not desired to limit the invention to the exact construction and process shown and described above. Accordingly, resort may be made to all suitable modifications and equivalents that fall within the scope of the invention as defined by the claims which follow.

What is claimed is:

1. A compressor-pump unit for use in a vapor-compression refrigeration system, the compressor-pump unit comprising:

a driving device including a rotatable shaft;

a compressor, coupled with a first portion of the shaft, for compressing gaseous refrigerant within the vapor-compression refrigeration system;

a liquid pump, coupled with a second portion of the shaft, for receiving liquid refrigerant having a first pressure and for discharging the received liquid refrigerant at a second pressure, the second pressure being higher than the first pressure by a predetermined amount such that the discharged liquid refrigerant is subcooled; and a sealable housing within which the first and second portions of the shaft, the compressor, and the pump are supported wherein the housing includes a refrigerant inlet and a refrigerant outlet for the compressor and a refrigerant inlet and a refrigerant outlet for the pump;

wherein the housing includes a pump cooling, refrigerant pathway for directing the gaseous refrigerant between the refrigerant inlet in the housing for the compressor and the compressor such that the gaseous refrigerant flows over and contacts a pump casing of the pump, whereby the gaseous refrigerant absorbs heat from the liquid refrigerant, through the pump casing, prior to the liquid refrigerant being discharged from the pump.

2. The compressor-pump unit of claim 1, wherein the shaft of the driving device has a third portion external to the housing.

3. The compressor-pump unit of claim 2, wherein the driving device includes a belt assembly external to the housing and coupled to the third portion of the shaft to rotate the first and the second portions of the shaft.

4. The compressor-pump unit of claim 2, wherein the driving device includes an electric motor coupled to the third portion of the shaft to rotate the first and the second portions of the shaft.

5. The compressor-pump unit of claim 1, wherein the driving device includes an electric motor having a rotor coupled with a third portion of the shaft to rotate the first and the second portions of the shaft, the electric motor being disposed within the housing.

6. The compressor-pump unit of claim 5, wherein the compressor has a discharge pathway for transmitting compressed gaseous refrigerant from the compressor to the compressor refrigerant outlet of the housing and wherein the compressor-pump unit further includes a liquid injection pipe having an inlet on the pump refrigerant outlet of the housing and an outlet on the discharge pathway of the compressor, the liquid injection pipe being wholly contained within the housing.

7. The compressor-pump unit of claim 5, wherein the electric motor is interposed between the compressor and the pump.

8. The compressor-pump unit of claim 7, the housing including a motor-cooling, refrigerant pathway for directing the gaseous refrigerant between the refrigerant inlet in the housing for the compressor and the compressor, wherein the electric motor is positioned within the motor cooling pathway to be cooled through contact with the gaseous refrigerant.

9. The compressor-pump unit of claim 1, wherein the pump is a centrifugal pump having an impeller coupled to the second portion of the shaft and further, wherein the housing includes a compressor end portion being configured to form the pump casing for the pump, the pump casing including a pump volute, the refrigerant inlet for the pump, and the refrigerant outlet for the pump.

10. The compressor-pump unit of claim 1, wherein:

the compressor includes a compressor housing and a discharge pathway within the compressor housing for storing compressed gaseous refrigerant within the compressor housing prior to discharge from the compressor housing;

the liquid pump includes a refrigerant outlet for discharging the higher, second pressure liquid refrigerant; and the compressor-pump unit includes a liquid injection pipe assembly with a liquid injection pipe section, the liquid injection pipe section having an inlet on the pump refrigerant outlet and an outlet on the discharge pathway of the compressor, whereby a volume of the higher, second pressure liquid refrigerant is diverted into the gaseous refrigerant in the discharge pathway within the compressor housing.

11. The compressor-pump unit of claim 10, the liquid injection assembly further including a control valve for measuring and controlling the volume of the diverted liquid refrigerant.

12. The compressor-pump unit of claim 11, wherein the liquid injection assembly further includes a feedback controller for continually monitoring and operating the control valve to control the volume of the diverted liquid refrigerant in response to pressure signals received from a pressure sensor positioned to sense pressures within the discharge pathway of the compressor and from a temperature sensor operable to sense temperature of refrigerant downstream from the compressor housing.

13. A vapor-compression refrigeration system for providing cooling with improved efficiency through utilization of liquid pressure amplification and liquid injection desuperheating, the refrigeration system comprising:

a condenser, an expansion device, an evaporator and a compressor each being interconnected with refrigerant piping, wherein refrigerant sequentially flows through the condenser, the expansion device, the evaporator, and the compressor;

a liquid pump interposed between, and interconnected with, the condenser and the expansion device, the liquid pump including an inlet port for receiving liquid refrigerant from the condenser having a first pressure and a discharge port through which the received liquid refrigerant is discharged at a second pressure, the second pressure being higher than the first pressure by a predetermined amount such that the discharged liquid refrigerant is subcooled;

a sealable housing within which the first and second portions of the shaft, the compressor, and the liquid pump are supported;

a driving device including a rotatable shaft, wherein the compressor is coupled with a first portion of the shaft and the liquid pump is coupled with a second portion of the shaft; and a liquid injection assembly including a liquid injection pipe section, the liquid injection pipe section having an inlet downstream of a discharge port of the liquid pump and an outlet in a discharge pathway of the compressor, whereby a volume of the liquid refrigerant discharged by the liquid pump is diverted into gaseous refrigerant being discharged from the compressor to desuperheat the gaseous refrigerant within the compressor discharge pathway.

14. The refrigeration system of claim 13, the liquid injection assembly further including a control valve for metering the volume of the liquid refrigerant diverted into the compressor discharge pathway.

15. The refrigeration system of claim 14, wherein the liquid injection assembly further includes a temperature sensor positioned to sense a temperature of the gaseous refrigerant discharged from the compressor at a predetermined point on the refrigerant piping between the compressor and the condenser and further includes a pressure sensor for sensing a pressure within the compressor discharge pathway, and wherein the control valve is responsive to the pressure sensed by the pressure sensor and the temperature sensed by the temperature sensor to meter the volume of the diverted liquid, whereby gaseous refrigerant flowing into the condenser is desuperheated to a substantially saturated vapor.

16. The refrigeration system of claim 14, wherein the liquid injection assembly further includes a feedback controller for monitoring and operating the control valve to maintain desuperheat of the gaseous refrigerant by controlling the volume of the diverted liquid refrigerant.

17. The refrigeration system of claim 16, wherein the feedback controller includes a pressure sensor for sensing a pressure of the gaseous refrigerant at a location downstream from the outlet of the liquid injection pipe section, the pressure sensor generating a signal to the feedback controller corresponding to the sensed pressure.

18. The refrigeration system of claim 17, wherein the feedback controller further includes a temperature sensor interposed between the condenser and the outlet of the liquid injection pipe section, the temperature sensor sensing a temperature of the mixture of the gaseous refrigerant and generating a signal corresponding to sensed temperature to the feedback controller.

19. The refrigeration system of claim 18, wherein the feedback controller includes a microprocessor device communicatively linked to the pressure sensor for receiving the pressure signal from the pressure sensor and for receiving the temperature signal from the temperature sensor, and wherein the microprocessor compares the received temperature signal to a saturated temperature value for the refrigerant retrieved from microprocessor memory based on the received pressure signal and wherein the feedback controller operates the control valve based on the pressure comparison completed by the microprocessor device to desuperheat to substantially saturated vapor the gaseous refrigerant flowing to the condenser.

20. The refrigeration system of claim 19, wherein the microprocessor device has stored in memory saturation temperature and pressure values for a plurality of refrigerants, and wherein the feedback controller provides a switch device to enable a user to select one of the plurality of refrigerants to match the refrigerant contained in the refrigeration system.

21. The refrigeration system of claim 19, wherein the housing includes an inlet port to the compressor discharge pathway for the liquid injection pipe section;

wherein the driving device includes an electric motor having a rotor coupled with a third portion of the shaft to rotate the first and the second portions of the shaft, the electric motor being disposed within the housing.

22. The refrigeration system of claim 13, wherein the housing includes a refrigerant inlet and a refrigerant outlet for the compressor and a refrigerant inlet and a refrigerant outlet for the liquid pump, and wherein the liquid injection assembly is contained within the housing.

23. The refrigeration system of claim 22, wherein the driving device includes an electric motor having a rotor coupled with a third portion of the shaft to rotate the first and the second portions of the shaft, the electric motor being disposed within the housing.

24. The refrigeration system of claim 23, the housing including a pump cooling, refrigerant pathway for directing the gaseous refrigerant between the refrigerant inlet in the housing for the compressor and the compressor such that the gaseous refrigerant flows over and contacts a pump casing of the pump, whereby the gaseous refrigerant absorbs heat from the liquid refrigerant, through the pump casing, prior to the liquid refrigerant being discharged from the pump.

25. A method of enhancing the operational efficiency of a vapor-compression refrigeration system having a compressor driven by a rotatable shaft of a driving device, a condenser, an expansion valve, and an evaporator serially connected by refrigerant piping, the method comprising the steps of:

interposing a liquid pump between the condenser and the expansion valve, wherein the liquid pump is connected to the condenser and the expansion valve with the refrigerant piping;

coupling the liquid pump to the rotatable shaft of the driving device, whereby the compressor and the liquid pump may be concurrently driven by the driving device;

positioning and supporting the compressor and the liquid pump within a sealable housing through which the rotatable shaft sealably passes, wherein the housing includes a pump cooling refrigerant pathway for directing gaseous refrigerant from the evaporator into heat transfer contact with a pump casing of the liquid pump;

driving the compressor with the rotatable shaft of the driving device to pump gaseous refrigerant received by the compressor from the evaporator through the condenser; and concurrently with the compressor driving step, driving the liquid pump with the rotatable shaft of the driving device to pump liquid refrigerant received from the condenser at a first liquid refrigerant pressure to the expansion valve at a second liquid refrigerant pressure, the second liquid refrigerant pressure being higher than the first liquid refrigerant pressure by a predetermined amount, whereby the liquid refrigerant is subcooled.

26. The method of claim 25, further including the step of positioning and supporting the compressor and the liquid pump within a sealable housing through which the rotatable shaft sealably passes.

27. The method of claim 26, wherein the compressor has a discharge pathway for transmitting compressed gaseous refrigerant from the compressor to a compressor refrigerant outlet of the housing and wherein the compressor-pump unit further includes a liquid injection pipe having an inlet on the pump refrigerant outlet of the housing and an outlet on the discharge pathway of the compressor, the liquid injection pipe being wholly contained within the housing, and wherein, the method further includes the step of injecting a volume of the liquid refrigerant discharged from the liquid pump into the discharge pathway of the compressor to desuperheat the gaseous refrigerant transmitted to the condenser.

28. The method of claim 25, further including the step of positioning and supporting the compressor, the liquid pump, and the driving device within a sealable housing, wherein the housing includes a pump cooling refrigerant pathway for directing gaseous refrigerant from the evaporator into heat transfer contact with a pump casing of the liquid pump.

29. The method of claim 25, further including the steps of:

positioning and supporting the compressor and the liquid pump within a housing, wherein the housing includes a discharge pathway for storing compressed gaseous refrigerant from the compressor prior to transmittal to the condenser and a refrigerant outlet downstream from the liquid pump;

providing a liquid injection pipe assembly with a liquid injection pipe section, the liquid injection pipe section having an inlet on the refrigerant outlet of the liquid pump and an outlet on the discharge pathway of the compressor; and using the liquid injection pipe assembly to inject a selectable volume of liquid refrigerant at the second liquid refrigerant pressure into the discharge pathway of the compressor to desuperheat the gaseous refrigerant.

30. The method of claim 29, wherein the liquid injection assembly further includes a control valve for measuring and controlling the selectable volume of the diverted liquid refrigerant.

31. The method of claim 30, wherein the liquid injection assembly further includes a feedback controller for continually monitoring and operating the control valve to select the selectable volume of the liquid refrigerant in response to pressure signals received from a pressure sensor positioned to sense pressures within the discharge pathway of the compressor and from a temperature sensor operable to sense temperature of gaseous refrigerant downstream from the housing.

* * * * *